US005102158A

United States Patent [19]

Erdei et al.

[11] Patent Number: 5,102,158

[45] Date of Patent: Apr. 7, 1992

[54] SAFETY SKI BINDING

[75] Inventors: Roland Erdei, Weigelsdorf; Hubert Wuerthner, Hainburg/Donau; Karl Stritzl, Wien; Franz Luschnig, Traiskirchen, all of Austria

[73] Assignee: TMC Corporation, Baar, Switzerland

[21] Appl. No.: 432,582

[22] Filed: Nov. 6, 1989

[30] Foreign Application Priority Data

Nov. 18, 1988 [AT] Austria ..... 2834/88

[51] Int. Cl.[5] ..... A63C 9/18

[52] U.S. Cl. ..... 280/633; 403/80; 403/329

[58] Field of Search ..... 410/104, 105; 212/269; 280/632, 633; 403/80, 109, 329; 248/225.1; 49/414, 423; 384/34, 37

[56] References Cited

U.S. PATENT DOCUMENTS

| | | | |
|---|---|---|---|
| 26,873 | 1/1860 | Crane | 49/414 |
| 489,937 | 1/1893 | Dambach | 49/414 |
| 4,045,923 | 9/1977 | Shanmugasundaram | 212/269 X |
| 4,109,891 | 8/1978 | Grendahl | 410/105 X |
| 4,114,945 | 9/1978 | Lutz | 384/37 X |
| 4,385,704 | 5/1983 | Spain et al. | 212/269 |
| 4,620,719 | 11/1986 | Stritzl | 280/633 |
| 4,811,925 | 3/1989 | Fujita et al. | 384/34 X |

FOREIGN PATENT DOCUMENTS

| | | | |
|---|---|---|---|
| 387151 | 12/1988 | Austria . | |
| 2614545 | 11/1988 | France | 280/633 |
| 1368253 | 1/1988 | U.S.S.R. | 212/269 |

*Primary Examiner*—Andres Kashnikow
*Assistant Examiner*—Michael Mar
*Attorney, Agent, or Firm*—Flynn, Thiel, Boutell & Tanis

[57] ABSTRACT

A safety ski binding includes a binding member guided in the longitudinal direction of a ski on a guide rail and releasably fixable in different positions therealong by an adjusting arrangement, the binding member being under the influence of at least one pressing spring which acts in the longitudinal direction of the ski and which facilitates compensation for play existing between the binding member and the guide rail. The pressing spring is arranged in a spring cage which has a crosswall and a bottom. To provide a constant pressure, the spring cage is provided with at least two downwardly convex leaf springs, or with at least two longitudinal ribs which extend along the two sides of the bottom and are downwardly convex and resilient in a section of their longitudinal length.

11 Claims, 1 Drawing Sheet

SAFETY SKI BINDING

FIELD OF THE INVENTION

This invention relates to a safety ski binding and, more particularly, to a safety ski binding which includes a binding member guided in the longitudinal direction of a ski on a guide rail and fixable in different positions therealong by an adjusting arrangement, the binding member or a base plate thereof being under the influence of at least one spring which acts in the longitudinal direction of the ski and which facilitates compensation for play existing in a vertical direction between the binding member and guide rail when a ski boot is not inserted, the spring being arranged in a spring cage which is provided with a crosswall and a bottom.

BACKGROUND OF THE INVENTION

A ski binding of the type to which the invention relates is already known, and is disclosed in Austrian Patent No. 387 151. Compensation for play between the binding member and the guide rail is achieved in this known ski binding by a pressing spring which, when the binding member is positionally locked, is bent to curve upwardly, this curvature pressing the base plate of the binding upwardly. Thus, the pressing spring also fulfills the function of play compensation so that, during pressing, even in the bent state of the spring, a portion of the force is ineffective. It is therefore necessary to select and use a more powerful pressing spring to achieve the action necessary for the pressing. This, however, also increases the force needed for adjustment of the binding.

A purpose of the invention is to overcome this disadvantage and to provide a ski binding in which compensation for play between the binding member and guide rail is effected independently from the pressing spring.

SUMMARY OF THE INVENTION

This purpose is attained according to the invention by providing resilient longitudinal ribs or arched leaf springs which apply pressure onto the binding housing or onto the base plate so that the play compensation is kept constant at all times independently of the pressing spring.

A further feature involves providing a spring cage with a crosswall having two surface sections urged by the resilient ribs or leaf springs against the underside of the binding member, which improves the flux of force from the resilient ribs or leaf springs to the binding member.

Further features involve providing a groove in a spring cage which slidably engages a rib on the binding member, or providing shoulders which center the binding member with respect to the guide rail, to assure a play-free guiding of the binding member transversely with respect to the longitudinal axis of the ski and parallel with respect to the upper side of the ski.

Making the spring cage a single integral part from an elastic material such as plastic, in the case of resilient ribs, simplifies the manufacture of the spring cage.

BRIEF DESCRIPTION OF THE DRAWINGS

Further details of the invention will be described in greater detail in connection with the drawings, in which.

DETAILED DESCRIPTION

Figure 1:
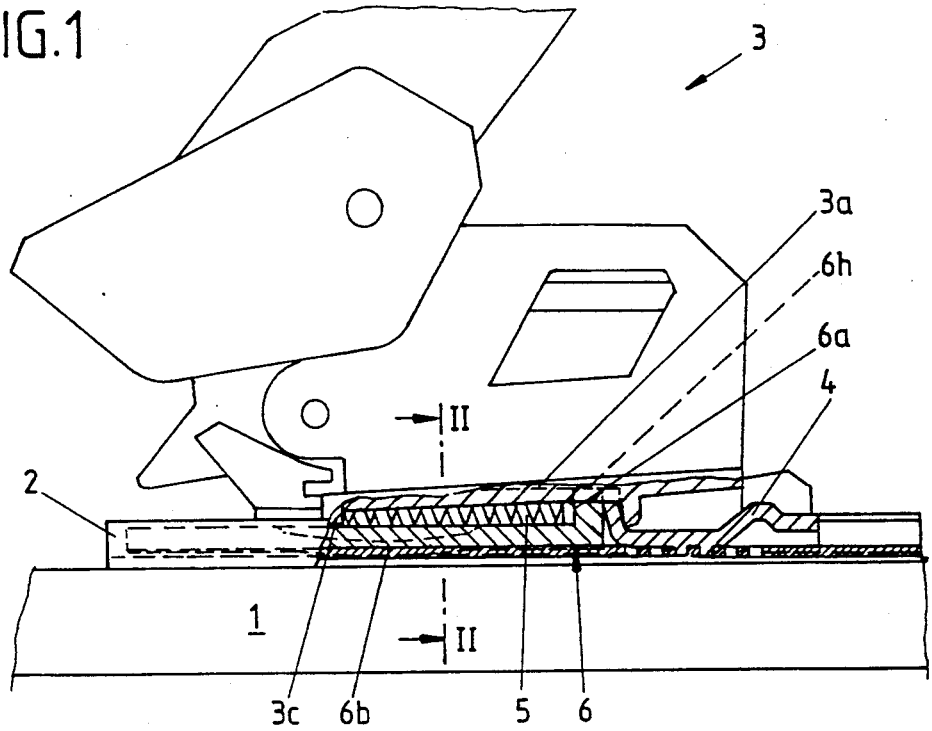
FIG. 1 is a partially sectional side view of a first embodiment of an inventive safety ski binding.
Figure 2:
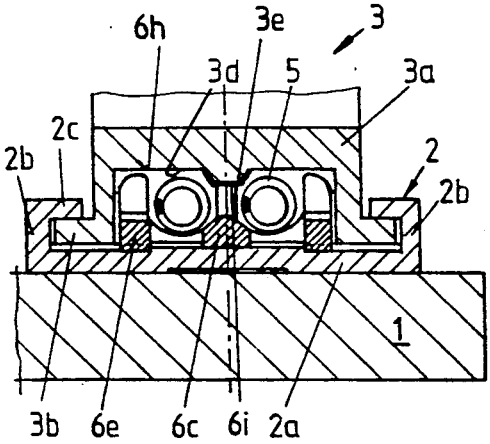
FIG. 2 is a sectional view taken along the line II—II in FIG. 1.

The safety ski binding illustrated in FIGS. 1 and 2 has an upwardly open U-shaped guide rail 2, which has a crosspiece 2*a* secured on the upper side of a ski 1 by means of screws (not illustrated), and on which a base plate 3*a* of a binding member 3 is movably guided in the longitudinal direction of the ski 1. The base plate 3*a* can be releasably fixed in a conventional manner in a desired position by means of an adjusting latch 4, in order to adapt the binding to different length ski boots. Two legs 2*b* of the U-shaped guide rail 2 carry at their upper ends inwardly projecting flanges 2*c*. The base plate 3*a* has outwardly projecting lateral guide flanges 3*b*, which in the mounted state of the binding member 3, as will be described later on, are pressed against the flanges 2*c* of the guide rail 2.

Figure 3:
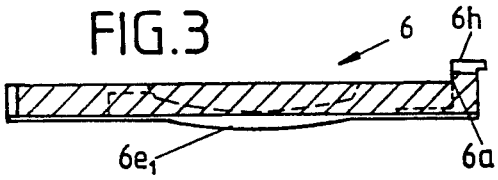
FIG. 3 is a sectional end view taken along the line III—III in FIG. 4.
Figure 4:
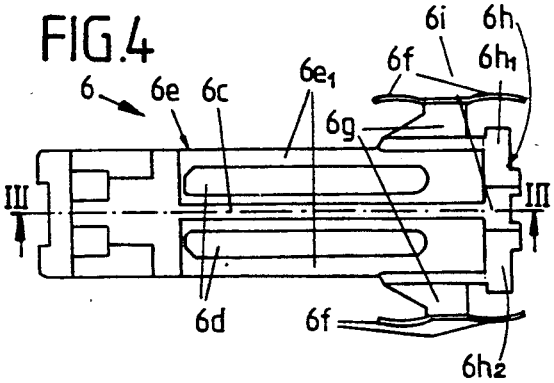
FIG. 4 is a top view of a spring cage which is a component of the embodiment of FIG. 1.

The base plate 3*a* has two helical compression or pressing springs 5 disposed in a spring cage 6, and can be moved on the guide rail 2 away from the ski boot against the urging of the pressing springs 5. Each pressing spring 5 extends between a downwardly directed shoulder 3*c* on the base plate 3*a* and a rear crosswall 6*a* of the spring cage 6. The crosswall 6*a* has an upper boundary surface 6*h*. The spring cage 6 is preferably manufactured of plastic, and is constructed in one piece. The bottom 6*b* of the spring cage 6 is defined by three parallel longitudinal ribs, namely one center rib 6*c* and two lateral ribs 6*e* (see FIGS. 2 and 4). Recesses 6*d* are provided between the two lateral ribs 6*e* and the center rib 6*c*, and extend in the longitudinal direction of the ski. The two lateral longitudinal ribs 6*e* are, as shown in FIGS. 3 and 4, tapered in thickness and arched convexly in a downward direction in a section $6e_1$ of their longitudinal extent, and thus are constructed resiliently. The crosswall 6*a* of the spring cage 6 has thereon two surface sections $6h_1$ and $6h_2$ which are higher than the longitudinal ribs 6*e*. The surface sections $6h_1$ and $6h_2$ form a boundary surface 6*h*. A groove 6*i* is provided in spring cage 6 between the two surface sections $6h_1$ and $6h_2$ of the boundary surface 6*h*. A longitudinally extending guide rib 3*e* of the base plate 3*a* is slidably received in and guided by the groove 6*i*. Furthermore, two lateral shoulders 6*g*, which are approximately T-shaped in a top view and each include two resilient flanges 6*f*, are formed on the spring cage 6 symmetrically with respect to a vertical longitudinal center plane of spring cage 6.

When the base plate 3*a* of the binding member 3 and the spring cage 6 are moved onto the guide rail 2 during assembly, the two lateral, downwardly convex resilient ribs 6*e* of the spring cage are tensioned. The two sections $6h_1$ and $6h_2$ of the boundary surface 6*h* on crosswall 6*a* are therefore urged against the bottom surface 3*d* of the base plate 3*a* and press the base plate 3*a* up until the guide flanges 3*b* are disposed against the flanges 2*c* of the guide rail 2 (see FIG. 2). The spring cage 6 is slidingly guided on the legs 2*b* of the guide rail 2 during movement of the base plate 3*a* by means of the two flanges 6*f* on its shoulders 6*g*, and is simultaneously centered by them relative to the guide rail 2.

The base plate 3*a* is, as evident from FIG. 1, tapered to be wedge-shaped in the direction of the ski, as viewed from the side, so that the binding member 3 assumes with respect to the guide rail 2, as viewed from the side, a slightly inclined position.

The binding member 3 is, when a ski boot is inserted, pressed upwardly in front and downwardly in back by the two pressing springs 5. The resilient ribs 6*e* are thereby tensioned slightly more than in their initially tensioned state. The friction caused by this deformation is, however, negligible as compared with that created during compensatory movement of the binding member 3 during the bending of the ski, so that compensatory movement of the ski bending can take place practically without negative influence from the two resilient ribs 6*e*.

Figure 5:
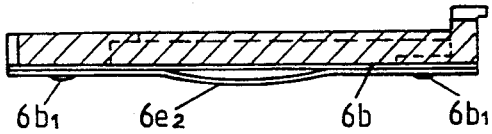
FIG. 5 is a view similar to FIG. 3 of a second embodiment of a spring cage for a ski binding embodying the invention.
Figure 1A:
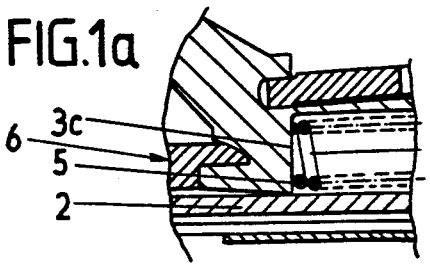
FIG. 1*a* is a detail of FIG. 1 in a larger scale.

Turning to the second embodiment of the invention illustrated in FIG. 5, the underside of the spring cage 6 is flat and the two lateral longitudinal ribs 6*e* each carry a downwardly convexly arched leaf spring $6e_2$, each of which is fastened by means of two rivets $6b_1$ to the bottom 6*b* of the spring cage 6.

The invention is not limited to the exemplary embodiments illustrated in the drawing and described above. Rather, various modifications of the same, including the rearrangement of parts, are possible without leaving the scope of the invention. For example, it is possible to provide in place of the two pressing springs a single pressing spring in the spring cage, which single spring is disposed between the two outer longitudinal ribs, the center longitudinal rib being omitted.

The embodiments of the invention in which an exclusive property or privilege is claimed are defined as follows:

1. In a safety ski binding which includes a binding member guided in a longitudinal direction of a ski on a guide rail and releasably fixable in different positions therealong by adjusting means, the binding member or a base plate thereof being under the influence of at least one spring acting in the longitudinal direction of the ski, the spring facilitating compensation for play existing in a vertical direction between the binding member and guide rail when a ski boot is not inserted, the spring being arranged in a spring cage which is provided with a crosswall and a bottom, the improvement comprising wherein the spring cage has at least two lateral longitudinal ribs having therebetween at least one recess, which longitudinal ribs extend along the two opposite sides of the bottom, are downwardly convex in a section of their longitudinal extent, and are designed resiliently and cause the crosswall of the spring cage to keep the base plate of the binding member pressed upwardly against flanges provided on the guide rail.

2. A safety ski binding according to claim 1, wherein the crosswall has a boundary surface which is vertically above the longitudinal ribs and has two sections which, under the influence of the resilient sections of the longitudinal ribs, engage the underside of the binding member.

3. A safety ski binding according to claim 2, wherein said spring cage includes a groove between the two sections of the boundary surface, said groove slidably receiving a guide rib provided on the binding member.

4. A safety ski binding according to claim 1, wherein the spring cage has two shoulders which are approximately T-shaped in a top view and carry resilient flanges which center the spring cage with respect to the guide rail.

5. A safety ski binding according to claim 1, wherein the spring cage is a single integral part manufactured of an elastic material which is preferably plastic.

6. A safety ski binding, comprising: a guide rail adapted to be fixed to a ski; a binding part supported on said guide rail for movement relative thereto in a first direction longitudinally of the ski; means for limiting movement of said binding part away from said ski relative to said guide rail in a second direction approximately normal to said first direction; first resilient means for yieldably urging said binding part in said first direction relative to said guide rail; and second resilient means independent of said first resilient means for yieldably urging said binding part in said second direction relative to said guide rail; including a member supported on said guide rail for movement relative thereto in said first direction longitudinally of the ski, and means for releasably securing said member against movement relative to said guide rail opposite said first direction, said first resilient means yieldably urging said binding part to move in said first direction relative to said member, and said second resilient means urging said member in said second direction relative to said guide rail, said member having a portion which engages said binding part and urges said binding part in said second direction relative to said guide rail; wherein said second means includes said member having an integral rib portion which extends approximately in said first direction, which is inherently resilient and is downwardly convexly arched, and which slidably engages said guide rail.

7. A safety ski binding according to claim 6, wherein said member includes a further integral rib portion which extends approximately in said first direction and is spaced from said first-mentioned rib portion in a third direction approximately perpendicular to said first and second directions, which is inherently resilient and is downwardly convexly arched, and which slidably engages said guide rail.

8. A safety ski binding according to claim 7, wherein said first resilient means includes a compression spring having two ends which are respectively supported on said member and said binding part.

9. A safety ski binding according to claim 6, wherein said portion of said member has two surface sections which face and engage said binding part and which are spaced from each other in a third direction substantially perpendicular to said first and second directions.

10. A safety ski binding according to claim 9, wherein said member includes a groove between said surface sections, and wherein said binding part has thereon a guide rib which is slidably received in said groove.

11. A safety ski binding, comprising: a guide rail adapted to be fixed to a ski; a binding part supported on said guide rail for movement relative thereto in a first direction longitudinally of the ski; means for limiting movement of said binding part away from said ski relative to said guide rail in a second direction approximately normal to said first direction; first resilient means for yieldably urging said binding part in said first direction relative to said guide rail; and second resilient means independent of said first resilient means for yieldably urging said binding part in said second direction relative to said guide rail; including a member supported on said guide rail for movement relative thereto in said first direction longitudinally of the ski, and means for releasably securing said member against movement relative to said guide rail opposite said first direction, said first resilient means yieldably urging said binding part to move in said first direction relative to said member, and said second resilient means urging said member in said second direction relative to said guide rail, said member having a portion which engages said binding part and urges said binding part in said second direction relative to said guide rail; wherein said member has two shoulders projecting outwardly therefrom in opposite directions approximately perpendicular to each of said first and second directions, and includes at an outer end of each said shoulder a resilient flange which slidably engages a respective inwardly facing surface on said guide rail, said resilient flanges on said shoulders maintaining said member in a centered position with respect to said guide rail.

* * * * *